US005324408A

United States Patent [19]

Kissane

[11] Patent Number: 5,324,408

[45] Date of Patent: Jun. 28, 1994

[54] APPARATUS FOR CONTROLLED SUPPLY OF ALUMINA

[75] Inventor: James P. Kissane, Portland, Australia

[73] Assignee: Portland Smelter Services Pty. Ltd., Victoria, Australia

[21] Appl. No.: 30,167

[22] PCT Filed: Apr. 29, 1991

[86] PCT No.: PCT/AU91/00169

§ 371 Date: Apr. 2, 1993

§ 102(e) Date: Apr. 2, 1993

[87] PCT Pub. No.: WO92/06230

PCT Pub. Date: Apr. 16, 1992

[30] Foreign Application Priority Data

Oct. 5, 1990 [AU] Australia ..... PK2658

[51] Int. Cl.[5] ..... C25C 3/14

[52] U.S. Cl. ..... 204/245

[58] Field of Search ..... 204/67, 243 R-247

[56] References Cited

U.S. PATENT DOCUMENTS

| | | | |
|---|---|---|---|
| 3,371,026 | 2/1968 | Kiley et al. | 204/245 |
| 3,901,787 | 8/1975 | Niizeki et al. | 204/245 |
| 4,049,529 | 9/1977 | Golla | 204/245 X |
| 4,321,115 | 3/1982 | Rebmann et al. | 204/245 X |
| 4,328,085 | 5/1982 | Friedl et al. | 204/245 |
| 4,435,255 | 3/1984 | Casdas | 204/245 X |
| 4,437,964 | 3/1984 | Gerphagnon et al. | 204/245 |
| 4,525,105 | 6/1985 | Jaggi | 204/245 X |
| 5,045,168 | 9/1991 | Dalen et al. | 204/245 |

FOREIGN PATENT DOCUMENTS

| | | |
|---|---|---|
| 31274/71 | 7/1971 | Australia . |
| 66481/74 | 3/1974 | Australia . |
| 73198/81 | 7/1981 | Australia . |
| 14784/88 | 10/1988 | Australia . |

OTHER PUBLICATIONS

Patent Abstract, Metallurgy, p. 18, Aluminium electrolyser . . . , 83-806124/44, (Dec. 1982).

Patent Abstract, Metallurgy, p. 23, Aluminium producing electrolyser . . . , 90-374562/50 (Apr. 1990).

*Primary Examiner*—Donald R. Valentine

*Attorney, Agent, or Firm*—Birch, Stewart, Kolasch & Birch

[57] ABSTRACT

Apparatus for the controlled supply of alumina to an electrolysis tank having an electrolyte crust breaking plunger (2) includes a supply chamber (19) connected to the entry port (16) of a dose holder (10). Alumina leaving an exit port (15) of the dose holder (10) passes via an inclined wall (9) to a delivery chute (21) which directs the alumina to a hole formed in the crust by the plunger. Valve means (14) movable with the plunger (2) controls the opening of the dose holder entry and exit ports (16, 15), closing one port as it opens the other, and allowing alumina to flow through the delivery chute (21) as the plunger (2) is retracted from the crust. The plunger movement required to control the valve means is such that alumina can be fed into the tank substantially continuously without meeting interference from the plunger.

5 Claims, 1 Drawing Sheet

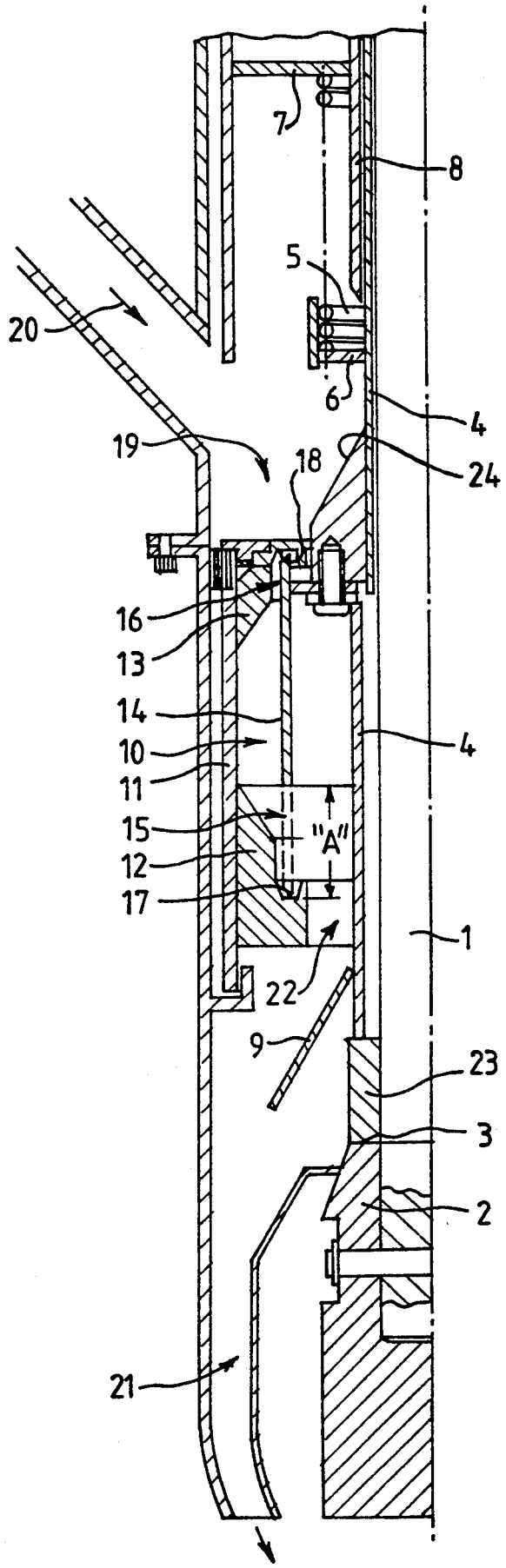
7
8
5
20
6
4
19
18
24
16
13
14
10
4
11
15
"A"
12
17
1
22
9
23
3
2
21

APPARATUS FOR CONTROLLED SUPPLY OF ALUMINA

BACKGROUND OF THE INVENTION

1. Field of the Invention

This invention relates to an apparatus for the controlled supply of alumina or other solid materials to an electrolytic tank in which the alumina is converted to aluminium.

2. Description of Related Art

In the electrolysis of alumina, solid alumina is dissolved in a tank or pot containing a molten electrolyte such as cryolite and it is desirable to maintain the alumina concentration in the electrolyte within a predetermined range. In current practice for the electrolysis of alumina, the alumina is fed in successive doses of predetermined size into one or more holes which are made in the electrolyte crust so that the alumina can be admitted when required. As the electrolysis of the alumina proceeds continuously, it would be desirable if the alumina consumed in the electrolysis process could be continuously replaced so as to maintain the optimum alumina concentration in the electrolyte. However, the optimum operating conditions are such that the electrolyte crust continuously reforms on the surface of the electrolyte making it difficult to continuously supply alumina to the molten electrolyte beneath the crust. For this reason, known alumina feeding procedures involve the use of a crust breaker which is operated intermittently to break the electrolyte crust and form a hole through which the solid alumina can be fed. However, the action of the crust breaker is necessarily such that the crust breaking mechanism, such as a pneumatically operated shaft with an appropriate chisel means (hereinafter referred to as a plunger) at its free end, will be moved in and out of the hole formed by the plunger.

In one known feeding procedure, two separate pneumatic systems are employed, one operating the crust breaking mechanism and the other operating the alumina feeding system. In this procedure, it is possible for the mechanism operating the crust breaking mechanism to form the necessary hole in the electrolyte crust and retract the crust breaker so that the feeding system can then be operated to place a charge of alumina into the hole formed by the crust breaker.

In another procedure, a single pneumatic system is used to operate the crust breaking mechanism, and the discharge of alumina from a storage device is coordinated with the downward movement of the crust breaker. In this procedure, the alumina charge is thus released when the crust breaker is through the crust so that the alumina is not free to enter the hole in the crust until the crust breaker is retracted. While this procedure has the advantage of a single pneumatic system, it is obvious that not all of the alumina will be able to pass through the hole into the electrolyte immediately when the crust breaker is retracted.

SUMMARY OF THE INVENTION

It is an object of the present invention to provide an improved alumina feeder assembly which can utilize a single pneumatic mechanism but avoid the disadvantages of the known system using such a single mechanism.

Accordingly the present invention provides a feeder assembly for an alumina electrolysis tank including a crust breaking mechanism operable to break a hole in crust formed on the surface of molten electrolyte, the crust breaking mechanism including a plunger with a cutting edge mounted on a reciprocable plunger shaft, and an alumina storage container adapted to release alumina as required for entry into the electrolyte through the hole in the crust, characterized in that the storage container feeds alumina through an alumina supply passage and an entry port into a supply chamber defined between an inner wall of the feeder assembly and an outer supply chamber wall; a supply chamber exit port controlled by a valve means connects the supply chamber to a dose holder having an inner wall mounted around and concentrically with the plunger shaft; the inner wall is urged downwardly towards the head of the plunger; an entry port in the dose holder is immediately adjacent to the supply chamber exit port so that when the valve means opens the supply chamber exit port, it simultaneously opens the dose holder entry port and alumina in the supply chamber is able to flow directly to the dose holder; the valve means is operatively associated with the inner wall so as to move in response to the movement of the inner wall between a first position in which the dose holder is closed to the supply chamber and a second position in which the dose holder is opened to the supply chamber, the valve means being open in its first position to a flow passage defined between the inner wall and the valve means and in its second position closing off the dose holder from the flow passage; the dose holder is a chamber defined by an outer wall, two radially inwardly directed end walls and a radially inward movable wall formed by the valve means, the movable wall defining with the respective end walls alternatively, depending on the position of the valve means, a dose holder exit port leading to the flow passage or an entry port leading to the supply chamber, so that when either port is fully closed, the other is fully opened; the lower end wall of the dose holder is downwardly and inwardly inclined towards a valve seat formed in the lower end wall and defining the lower part of the dose holder exit port; the valve seat in the lower end wall provides a stop to terminate the downward travel and hold the valve means against the downward urging of the associated inner wall while the plunger shaft may be driven further downwardly to break the electrolyte crust; striker means on the plunger shaft which meets the lower edge of the inner wall as the plunger shaft is raised from its crust breaking operation and raises the inner wall and its associated valve means to close the entry port and open the exit port of the dose holder, and an inclined wall connected adjacent to the lower end of the inner wall of the feeder assembly and terminating at its lower free edge at or within the entry portion of a delivery chute adapted to be mounted below the feeder assembly and to provide a funnel-like action to direct alumina which leaves the dose holder to one or more outlets terminating in use above the hole in the electrolyte crust.

The feeder assembly of the present invention includes a crust breaking mechanism which is preferably pneumatically operated. The crust breaking mechanism includes a plunger with a cutting edge for breaking the crust mounted on a reciprocable plunger shaft. The plunger shaft preferably carries striker means which may consist of a collar adjacent the plunger or a shoulder by the junction of the plunger shaft and the plunger.

The feeder assembly further includes at least one storage container comprising a hopper or like vessel for finely divided alumina. Other storage containers may be associated with the feeder assembly for other additives to the electrolysis tank such as aluminium fluoride, calcium fluoride, crushed bath, soda ash, or cryolite. The other storage containers may be adapted to feed their contents into the tank in a similar manner to that described below for the alumina.

A supply chamber provided between the storage container and a dose holder includes a preferably substantially cylindrical inner wall mounted around and concentrically with the plunger shaft. The inner wall is urged downwardly towards the head of the plunger, preferably by spring pressure exerted between a radially outwardly extending flange on the inner wall and a feeder assembly outer wall which is also mounted concentrically with the plunger shaft. The feeder assembly outer wall may include a radially extending flange more remote from the plunger head than the flange on the inner wall so that a coil spring mounted between the respective inner wall and outer wall flanges can exert the desired pressure urging the inner wall downwardly until its downward movement is terminated. The spring is mounted in the upper portion of the supply chamber so that alumina in the supply chamber will not interfere with the spring operation.

The supply chamber is defined between the inner wall of the feeder assembly and a preferably substantially cylindrical outer supply chamber wall. The supply chamber includes an entry port connected to an alumina supply passage below the inner wall flange and an exit port controlled by a valve means. The capacity of the supply chamber is preferably at least that of the dose holder. The inner wall at the supply chamber is preferably supplemented by a substantially downwardly and outwardly directed supply chamber side wall which terminates at its lower edge by the supply chamber exit port. Preferably the supply chamber side wall is inclined at an angle greater than the angle of repose of the alumina which is to pass through the supply chamber. This ensures that the alumina will flow freely through the chamber.

The supply chamber exit port is immediately adjacent to an entry port in the dose holder so that when the valve means opens the exit port of the supply chamber, it simultaneously opens the entry port to the dose holder, and alumina in the supply chamber is able to flow directly to the dose holder.

The valve means is operatively associated with the inner wall so as to move in response to the movement of the inner wall between a first position in which the dose holder is closed to the supply chamber, and a second position in which the dose holder is opened to the supply chamber. In its first position, the valve means is open to a flow passage defined between the inner wall and the valve means. In its second position, the valve means closes off the dose holder from the flow passage. The valve means is preferably substantially cylindrical and is connected to the inner wall between its free end edges. Each of the respective free end edges of the cylindrical valve means is adapted to seat in an annular seat defined at the opposite ends of the dose holder.

The dose holder is a chamber defined by an outer wall which is preferably substantially cylindrical and has two radially inwardly directed end walls in which the respective annular seats are defined, and a radially inward movable wall formed by the valve means. Depending on the position of the valve means, the dose holder will always include an open port constituting an exit port leading to the flow passage or an entry port leading to a supply chamber. The nature of the port in the dose holder is controlled by the movement of the valve means so that when either port is fully closed, the other is fully open.

Preferably the lower end wall is substantially downwardly and inwardly inclined at an angle greater than the angle of respose of the alumina powder which is to be fed through the dose holder. This inclination of the lower end wall ensures that all the alumina powder (other than that held in the annular seat) will flow from the dose holder when the exit port is open.

The inclination of the upper end wall is substantially downwardly and outwardly. The upper end wall is preferably also inclined at an angle greater than the angle of repose of the alumina powder which is to be fed through the dose holder. This inclination of the upper wall ensures that the dose chamber will be filled with alumina, thus providing the desired accurately reproducible dosage.

The annular seat in the lower end wall not only provides a means of sealing the exit port of the dose holder. It also provides a stop to terminate the downward travel of the valve means and the associated inner wall which occurs when the plunger shaft is lowered in response to the downward urging of the spring or other pressure exerting means. The valve means is held in the lower end wall seat by the downward pressure while the plunger shaft may be driven further downwardly if the crust is to be broken.

When the plunger shaft is raised, means consisting of the plunger head itself, or the preferred striker means, meets the lower edge of the inner wall and raises it and the associated valve means to close the entry port and open the exit port of the dose holder. The upward movement of the inner wall is terminated when the upper end edge of the valve means seats within the annular seat in the upper wall of the dose holder.

The feeder assembly further includes an inclined wall connected adjacent to the lower end of the inner wall. The inclined wall is preferably of substantially frustoconical form and terminates at its lower, free edge at or within the entry portion of a delivery chute.

The delivery chute is adapted to be mounted below the feeder assembly and is adapted to provide a funnel-like action to direct alumina which leaves the dose holder to one or more outlets which terminate in use above the hole in the electrolyte crust. The delivery chute preferably directs all the alumina leaving the lower edge of the inclined wall at the base of the inner wall, towards one or more delivery outlets 5.

To assist a further understanding of the invention, reference is now made to the accompanying drawing which illustrates one preferred embodiment of the present invention. It is to be appreciated that this embodiment is given by way of illustration only and that the invention is not to be limited by this illustration.

BRIEF DESCRIPTION OF THE DRAWING

FIG. 1 is a diagrammatic sectional view of the present invention.

DETAILED DESCRIPTION OF PREFERRED EMBODIMENT

The drawing shows, somewhat diagrammatically, one half only of a sectional view of a preferred form of feeder assembly. Plunger shaft 1 is connected to plunger 2, and shoulder 3, which is at the junction of plunger shaft 1 and plunger 2, abuts striker means 23 on inner wall 4 in the position shown. Inner wall 4 is urged downwardly by spring 5 which is held between flange 6 on inner wall 4 and flange 7 on outer wall 8. Inclined wall 9 at the lower end of inner wall 4 is connected adjacent to the junction of inner wall 4 and the striker means 23.

The chamber forming dose holder 10 is defined between side wall 11 and end walls 12 and 13, together with valve means 14 which comprises the moveable wall connected to inner wall 4. In the drawing, valve means 14 is shown with exit port 15 of dose holder 10 open, while entry port 16 is closed. Annular seats 17 and 18 for the respective end edges of valve means wall 14 are formed in the respective end walls 12 and 13.

Supply chamber 19 is filled generally below the level of flange 6 by alumina entering as indicated by arrow 20 from an alumina storage container. Inclined wall 24 supplements inner wall 4 to direct the alumina in chamber 19 to entry port 16. Delivery chute 21 is connected as indicated to the outermost wall of the feeder assembly and is adapted to direct the alumina leaving dose holder 10 and flowing via flow passage 22 and down inclined wall 9 into the hole in the electrolyte crust which has been formed by plunger 2. It will be appreciated that it was only necessary for the valve means to move the distance A for a charge of alumina to be released from the dose holder. the movement required for the plunger to break through the electrolyte crust is considerably greater than that represented by distance A.

It will be appreciated that the present invention allows the design and operation of a feeder system which utilizes only a single pneumatic mechanism coordinated with the supply of alumina to the hole in the electrolyte crust formed by the crust breaking mechanism and that the alumina can be fed directly into the hole when the crust breaking mechanism is retracted from the hole. Although some alumina flows directly through the dose holder while the valve means is being moved from the position in which the exit port is open to the position where the entry port is open, substantially all of the alumina released from the dose holder is able to flow directly into the hole in the electrolyte crust.

It is a further advantage of the present invention that the downward movement of the plunger can be limited when it is desired only to activate the valve means so as to recharge the dose holder. It is not necessary for the plunger to travel downwardly to the full extent required to break the crust, each time some downward movement is required to recharge the dose holder. The dose holder may thus be recharged and the plunger retracted to release the charge of alumina, without the plunger travelling fully through the electrolyte crust. Hence plunger wear is considerably reduced.

The angles of the dose holder end walls are greater than the angle of repose of alumina, so the alumina charging procedure is not affected to the same extent as in the present feeding procedures by variations in the quality of the alumina supplied which leads to more consistent charge volume precision. Selection of appropriate dose holder volume allows frequent feeding of alumina into the electrolyte bath in charges smaller than current charge sizes thus assisting in maintaining the alumina concentration more substantially constant.

I claim:

1. A feeder assembly for an alumina electrolysis tank including a crust breaking mechanism operable to break a hole in crust formed on the surface of molten electrolyte, the crust breaking mechanism including a plunger with a cutting edge mounted on a reciprocable plunger shaft, and an alumina storage container adapted to release alumina as required for entry into the electrolyte through the hole in the crust, characterized in that the storage container is adapted to feed alumina through an alumina supply passage and an entry port into a supply chamber defined between an inner wall of the feeder assembly and an outer supply chamber wall; a supply chamber exit port controlled by a valve means connects the supply chamber to a dose holder, the inner wall is mounted around and concentrically with the plunger shaft adjacent the dose holder; and the inner wall is urged downwardly towards the head of the plunger; an entry port in the dose holder is immediately adjacent to the supply chamber exit port so that when the valve means opens the supply chamber exit port, it simultaneously opens the dose holder entry port and alumina in the supply chamber is able to flow directly to the dose holder; the valve means is operatively associated with the inner wall so as to move in response to the movement of the inner wall between a first position in which the dose holder is closed to the supply chamber and a second position in which the dose holder is opened to the supply chamber, the valve means being open in its first position to a flow passage defined between the inner wall and the valve means and in its second position closing off the dose holder from the flow passage; the dose holder is a chamber defined by an outer wall, two radially inwardly directed end walls and a radially inward movable wall formed by the valve means, the movable wall defining with the respective ends walls alternatively, depending on the position of the valve means, a dose holder exit port leading to the flow passage or an entry port leading to the supply chamber, so that when either port is fully closed, the other is fully opened; the lower end wall of the dose holder is downwardly and inwardly inclined towards a valve seat formed in the lower end wall and defining the lower part of the dose holder exit port; the valve seat in the lower end wall provides a stop to terminate the downward travel and hold the valve means against the downward urging of the associated inner wall while the plunger shaft may be driven further downwardly to break the electrolyte crust; striker means on the plunger shaft which meets the lower edge of the inner wall as the plunger shaft is raised from its crust breaking operation and raises the inner wall and its associated valve means to close the entry port and open the exit port of the dose holder, and an inclined wall connected adjacent to the lower end of the inner wall of the feeder assembly and terminating at its lower free edge at or within the entry portion of a delivery chute adapted to be mounted below the feeder assembly and to provide a funnel-like action to direct alumina which leaves the dose holder to one or more outlets terminating in use above the hole in the electrolyte crust.

2. The feeder assembly as claimed in claim 1, wherein the lower end wall of the dose holder is substantially downwardly and inwardly inclined at an angle greater than the angle of repose of the alumina powder which is to be fed through the feeder assembly.

3. The feeder assembly as claimed in claim 2, wherein the upper end wall of the dose holder is substantially downwardly and outwardly inclined at an angle greater than the angle of repose of the alumina powder which is to be fed through the feeder assembly.

4. The feeder assembly as claimed in claim 1, wherein the valve means is substantially cylindrical, is connected to the inner wall between its free end edges, and seats in annular valve seats formed in the upper and lower end walls of the dose holder.

5. The feeder assembly as claimed in claim 1, wherein the supply chamber is formed with an inclined inner wall which terminates at its lower edge by the supply chamber exit port.

* * * * *